US007201707B1

(12) United States Patent
Moon

(10) Patent No.: US 7,201,707 B1
(45) Date of Patent: Apr. 10, 2007

(54) ELLIPTICAL EXERCISE MACHINE WITH ADJUSTABLE STRIDE LENGTH

(75) Inventor: Daniel R. Moon, Riverside, IL (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 11/330,602

(22) Filed: Jan. 12, 2006

(51) Int. Cl.
*A63B 22/00* (2006.01)

(52) U.S. Cl. ..... 482/52; 482/57

(58) Field of Classification Search ..... 482/51–52, 482/57, 70, 79–80
See application file for complete search history.

(56) References Cited

U.S. PATENT DOCUMENTS 4,786,050 A 11/1988 Geschwender
6,183,398 B1 2/2001 Rufino et al.
6,648,800 B2 11/2003 Stearns et al.
6,835,166 B1 12/2004 Stearns et al.
6,905,442 B1 * 6/2005 Lee et al. ..... 482/52
6,994,656 B2 * 2/2006 Liao et al. ..... 482/52
7,041,034 B1 * 5/2006 Stearns et al. ..... 482/52

* cited by examiner

*Primary Examiner*—Stephen R. Crow
(74) *Attorney, Agent, or Firm*—Lewis, Rice & Fingersh, L.C.

(57) ABSTRACT

An elliptical exercise machine and methods for using the machine where the horizontal length of the stride of the ellipse can be adjusted by the user without the user having to alter the vertical dimension of the ellipse by an equivalent amount. The machine provides for alteration using an inverted pendulum arm which is driven by rotation of a rail and which in turn drives a footskate on the rail. The position for the driving of the inverted pendulum arm by the rail and the driving of the footskate by the inverted pendulum arm are adjustable relative to each other so as to provide for multiple different stride lengths in exercising. The machine may allow for this adjustment to occur during the performance of an exercise routine.

20 Claims, 9 Drawing Sheets

ELLIPTICAL EXERCISE MACHINE WITH ADJUSTABLE STRIDE LENGTH

BACKGROUND

1. Field of the Invention

This disclosure relates to the field of elliptical exercise machines. In particular, to elliptical exercise machines which allow for alteration in the shape of the foot path.

2. Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints or similar structures where the impact from many aerobic exercise activities can cause injury. Therefore, those involved in the exercise industry are continuously seeking ways to provide users with exercises that have all the benefits of aerobic exercise, without the damaging side effects.

Most low-impact aerobic exercises have traditionally been difficult to perform. Many low-impact aerobic exercises (such as those performed in water) traditionally require performance either outside or at a gym. Cold weather, other undesirable conditions, and cost can make these types of aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, are either too physically demanding on the user or too complicated to use. In either case, the machine often falls into disuse. Recently, a class of machines which are referred to as "elliptical machines" or "elliptical cross-trainers" have become very popular due to their ease of use and their provision of relatively low-impact aerobic exercise.

Generally in these types of machines, a user performs a motion using their legs that forces their feet to move in a generally elliptical motion about each other. This motion is designed to simulate the motion of the feet when jogging or climbing but the rotational motion is "low-impact" compared to jogging or climbing where the feet regularly impact a surface. In an elliptical machine, a user uses a fairly natural motion to instead move their feet through the smooth exercise pattern dictated by the machine. This motion may also be complemented by them moving their arms in a reciprocating motion while pulling or pushing various arms on the machine whose motion is connected to the motion of the feet, and vice-versa.

Currently, the biggest problem with elliptical machines is that the dimensions of the elliptical pathway followed by the user's feet are generally severely limited in size and shape by the design of the machine. The elliptical pathway generated by these machines is often created by the interaction of a plurality of different partial motions, and attempts to alter the motion of a user in one dimension also alters the motion in another. It is desirable that users have the option to arrange the machine so that the ellipse can be tailored to fit their stride and to change during the exercise, but with machines on the market today, that generally is not possible.

The problem is most simply described by looking at the elliptical motion the feet make when using an elliptical exercise machine. This elliptical motion can be described by the dimensions of the ellipse. Since a user generally stands upright on an elliptical machine, the user's feet travel generally horizontally relative to the surface upon which the machine rests. This represents the user's stride length or how far they step. Further, the user's feet are raised and lowered relative to the surface as they move through the ellipse. This is the height to which the user's feet are raised. How a user steps depends on the type of action they are performing. A more circular or vertical ellipse will often correspond more to the motion made while climbing, while a slightly more elongated or horizontal ellipse is more akin to walking, and a significantly elongated ellipse can be more akin to the motion of running.

As a user's speed on the machine increases or decreases, the resistance imparted by the machine increases or decreases, or simply based on the size of the user, it can be desirable for the machine to alter the type of stride the user is making (by elongating or shortening the stride) to better correspond to a more natural movement. This allows the user to move through a range of different activities during an exercise session, providing for a beneficial workout.

In elliptical machines currently, the size and shape of the ellipse is generally fixed by the construction of the machine. That is, the footrests (the portion of an elliptical machine that will traverse the same ellipse as the user's feet) are generally forced to proscribe only a single ellipse when the machine is used and that ellipse is generally unchangeable. Some machines allow for some alteration of this ellipse, but generally those machines increase both dimensions of the ellipse, not just the horizontal component, and usually require moveable arms be part of the adjustment process. That is, the user can adjust the total size of the ellipse, but the ratio of the ellipse's components remains relatively constant, and the user is forced to have the arm swing adjust in conjunction with foot path alteration.

This arrangement means that many users are not comfortable with the stride of an elliptical machine as it is either too long or too short for their stride. Even if the stride is adjustable, the user may still be uncomfortable. For some users, the stride will be much too short compared to their normal stride and attempts to increase the stride length result in their feet being raised uncomfortably high (e.g. turning a walking or jogging exercise motion into more of a climbing motion), while for others the same machine's stride can be much too long (resulting in overstretching of their legs as if they are running all the time). Further, a user may desire to tailor the machine's motion for the general type of exercise they want to perform (e.g., more jogging motion or more climbing motion) and may wish to alter the motion during an exercise session to have a more varied workout.

SUMMARY

Because of these and other problems in the art, described herein, among other things, are elliptical exercise machines where the length of the horizontal dimension (stride) of the ellipse can be adjusted by the user independent of altering the vertical dimension of the ellipse by an equivalent amount. This is generally referred to as having an "adjustable stride length" in the elliptical machine. Further, the machines described herein are generally intended to allow for alteration of the stride length during the exercise or "on-the-fly" so that a user can vary their stride length throughout an exercise to make the exercise more comfortable and to provide for a more varied workout.

There is described herein, amongst other things, an elliptical exercise machine comprising: a frame; at least two crankshafts rotationally connected to the frame; a rail attached to the crankshafts so that the rail traverses a path in conjunction with the rotation of the crankshafts; a footskate capable of reciprocating motion on the rail; an interface arm, the interface arm having a distal and proximal end and a length therebetween, the proximal end of the interface arm being connected to the rail; an inverted pendulum arm having a proximal and distal end and a length therebetween, the inverted pendulum arm rotating about an axis of rotation located toward the proximal end of the inverted pendulum arm; a coupler connecting the distal end of the interface arm to the inverted pendulum arm at a point along the length of the inverted pendulum arm, the distance between the coupler and the first axis defining a first radius; and a transfer arm having a proximal and distal end and a length therebetween, the transfer arm being attached at the proximal end to the inverted pendulum arm, the transfer arm also being connected at the distal end to the footskate, the distance between the proximal end of the transfer arm and the first axis defining a second radius; wherein the interface arm causes the inverted pendulum arm to reciprocate about the first axis, which in turn causes the transfer arm to make the footskate reciprocate on the rail; and wherein the first radius and the second radius are adjustable relative to each other.

In embodiments of the machine the second radius is adjustable and the first radius is fixed or the first radius is adjustable and the second radius is fixed.

In an embodiment the machine further comprises an adjustment mechanism for adjusting at least one of the first radius and the second radius including elements such as, but not limited to, a hydraulic cylinder, a worm screw, a hand powered system or an electrically powered system.

In an embodiment of the machine at least one of the crankshafts is attached to a flywheel and may be attached to a resistance device.

In an embodiment of the machine, the position of the rail at any selected point of rotation, is parallel to the position of the rail at any other selected point of rotation, the machine may also include an arm exercise mechanism which oscillates relative to the frame through an angle which is independent of the reciprocation of the footskate.

There is also described herein, a method of altering the stride length of an elliptical exercise machine during an exercise, the method comprising: providing an elliptical exercise machine; the machine including: a frame; at least two crankshafts rotationally connected to the frame; a rail attached to the crankshafts so that the rail traverses a path in conjunction with the rotation of the crankshafts; a footskate capable of reciprocation motion on the rail; an interface arm the interface arm having distal and proximal ends and a length therebetween, the proximal end of the interface arm being connected to the rail; an inverted pendulum arm having a proximal and distal end and a length therebetween, the inverted pendulum arm rotating about an axis of rotation located toward the proximal end of the inverted pendulum arm; a coupler connecting a distal end of the interface arm to the inverted pendulum arm along the length of the inverted pendulum arm, the distance between the coupler and the first axis defining a first radius; and a transfer arm having a proximal and distal end and a length therebetween, the transfer arm being attached at the proximal end to the inverted pendulum arm, the transfer arm also being connected at the distal end to the footskate, the distance between the proximal end of the transfer arm and the first axis defining a second radius; operating the machine so that the interface arm causes the inverted pendulum arm to reciprocate about the first axis, which in turn causes the transfer arm to reciprocate the footskate on the rail; and adjusting the first radius or the second radius relative to the other while the machine is operating.

In embodiments of the method during the step of adjusting, the second radius is adjusted and the first radius remains constant or the first radius is adjusted and the second radius remains constant.

DESCRIPTION OF PREFERRED EMBODIMENT(S)

Although the machines, devices, and methods described below are discussed primarily in terms of their use with a particular layout of an elliptical exercise motion machine utilizing two rotational crankshafts, one of ordinary skill in the art would understand that the principles, methods, and machines discussed herein could be adapted, without undue experimentation, to be useable on an elliptical motion machine which generates its elliptical motion through the use of other systems.

The invention disclosed herein primarily relates to elliptical exercise machines where a reciprocating footskate which traverses a fixed linear portion of a rail is replaced by a system where the linear traversal is adjustable during an exercise to allow for quick and convenient alteration of the horizontal stride length of the user utilizing the machine, without significantly altering their vertical stride height on the machine.

For the purposes of this disclosure, the terms horizontal and vertical will be used when referring to the dimensions of the ellipse drawn by the user's feet. One of ordinary skill in the art will understand that depending on the arrangement of the parts and how the machine is used, the ellipse traversed by the user's feet may be at an angle to the vertical and horizontal. That is, a line connecting the two axes of the ellipse may not be completely horizontal or completely vertical, or in some cases it may be. For the purposes of this disclosure, when the horizontal dimension of the ellipse is referred to, it is referring to the longest dimension of the ellipse (line through both axes) in the most common form of operation, and the vertical dimension is the shortest dimension of the ellipse (line evenly spaced between the two axes). These dimensions are not used to strictly mean horizontal and vertical relative to the earth. Further, most of this discussion will often refer to the operation of a single side of an exercise machine, one of ordinary skill in the art would understand that the other side will operate in a similar manner.

Further, while the system discusses elliptical motion, it should be recognized that that term, as is used in the art of exercise machines, does not require the foot of the user to traverse a true ellipse, but that the foot of the user traverses a generally elliptical or similar rotational shape. The shape will generally not be circular, but may be circular, oval, elliptical, in the shape of a racetrack, kidney-shaped, or in any other shape having a relatively smoothly curving perimeter with a horizontal and vertical component of movement.

Figure 1:
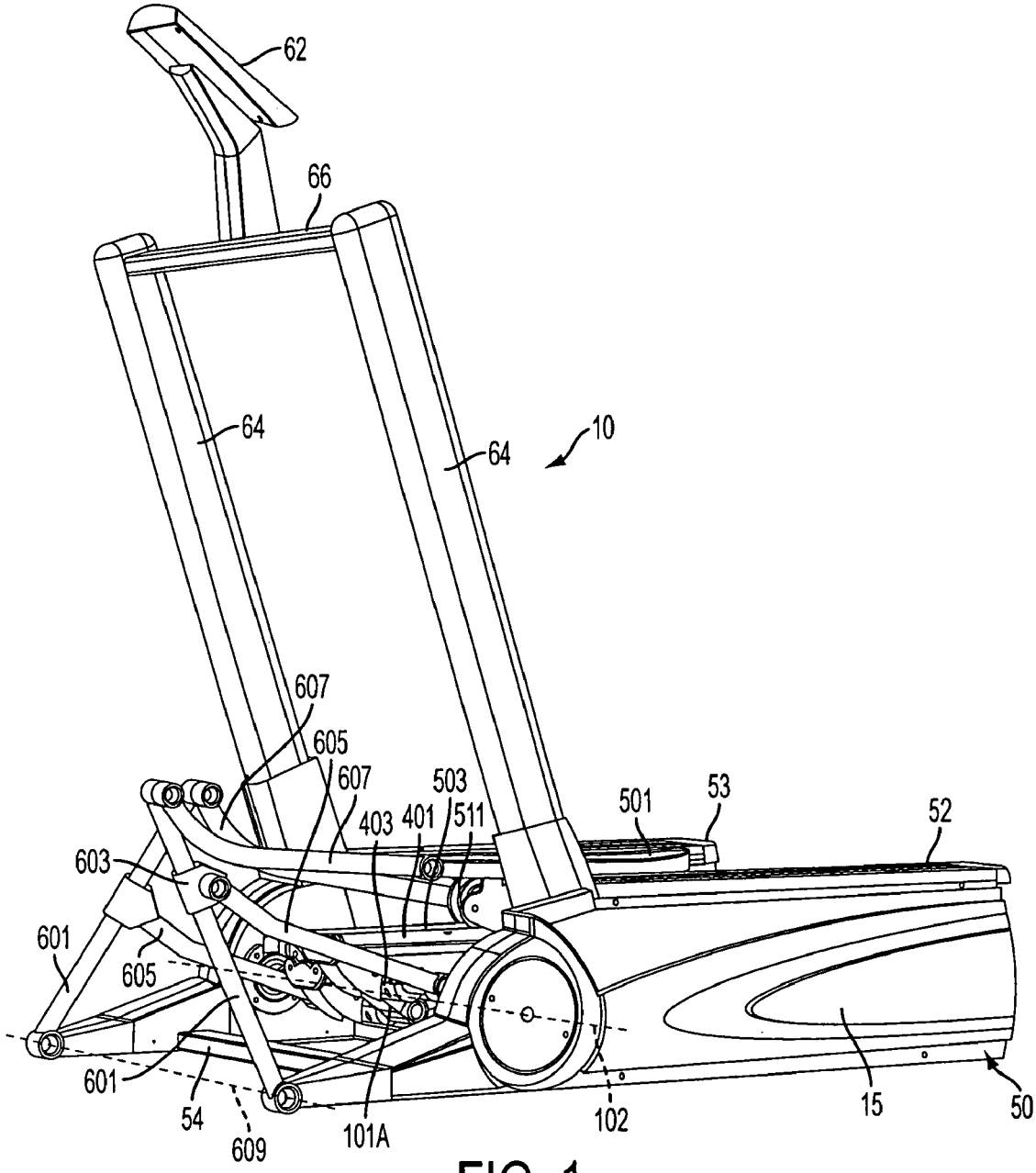
FIG. 1 shows a front perspective view of an embodiment of an exercise machine with adjustable stride length with an optional frame cover in place.
Figure 2:
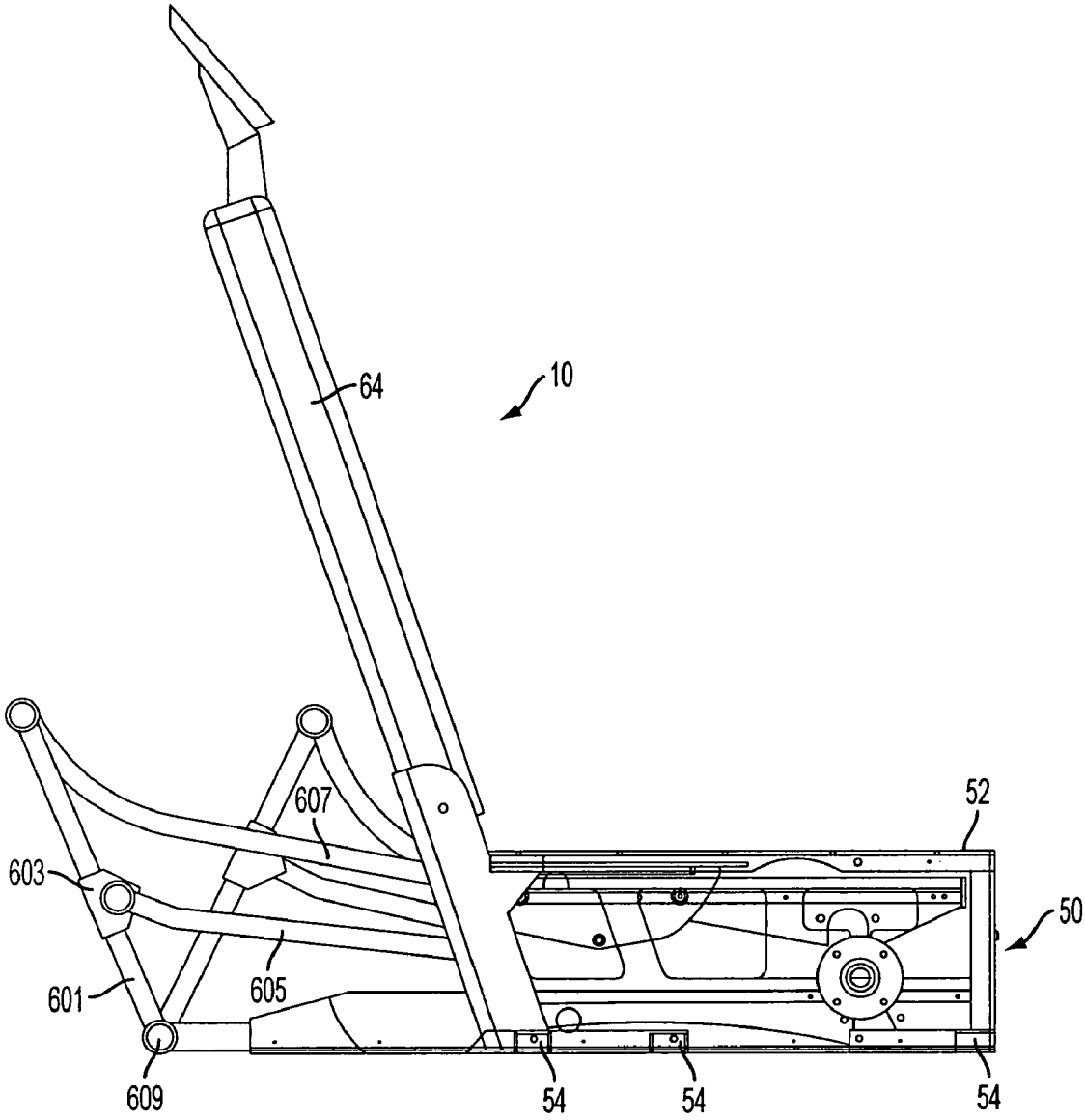
FIG. 2 shows a left side view of the embodiment of FIG. 1 with the frame cover removed.
Figure 3:
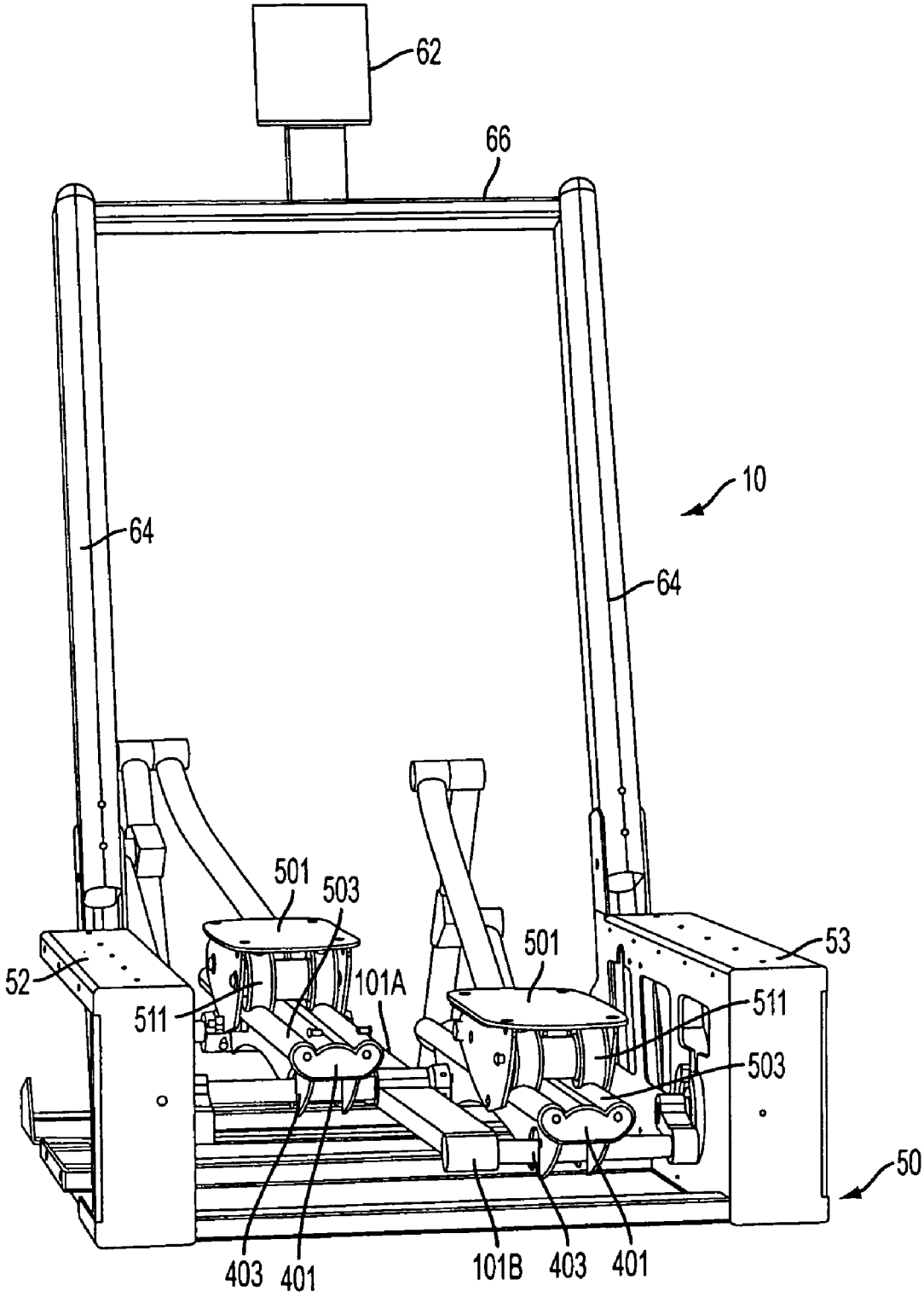
FIG. 3 shows a rear side view of the embodiment of FIG. 1 with the frame cover removed.

FIGS. 1 through 3 depict a first embodiment of a compact elliptical motion exercise machine (10) including an adjustable stride length of the type that may be adjusted during the exercise. The exercise machine (10) is comprised of a frame (50) of generally rigid construction which will sit stably on a surface to provide for the general shape of the machine (10) as shown in FIGS. 1 through 3. The frame (50) is generally constructed of strong rigid materials such as, but not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also generally be designed so as to stably support a user utilizing the exercise machine (10) and prevent the machine from having undue sway or other undesirable motion while the user is exercising. In the depicted embodiment, frame (50) includes two major substructures, left and right main supports (52) and (53), and crossbeams (54).

Figure 5:
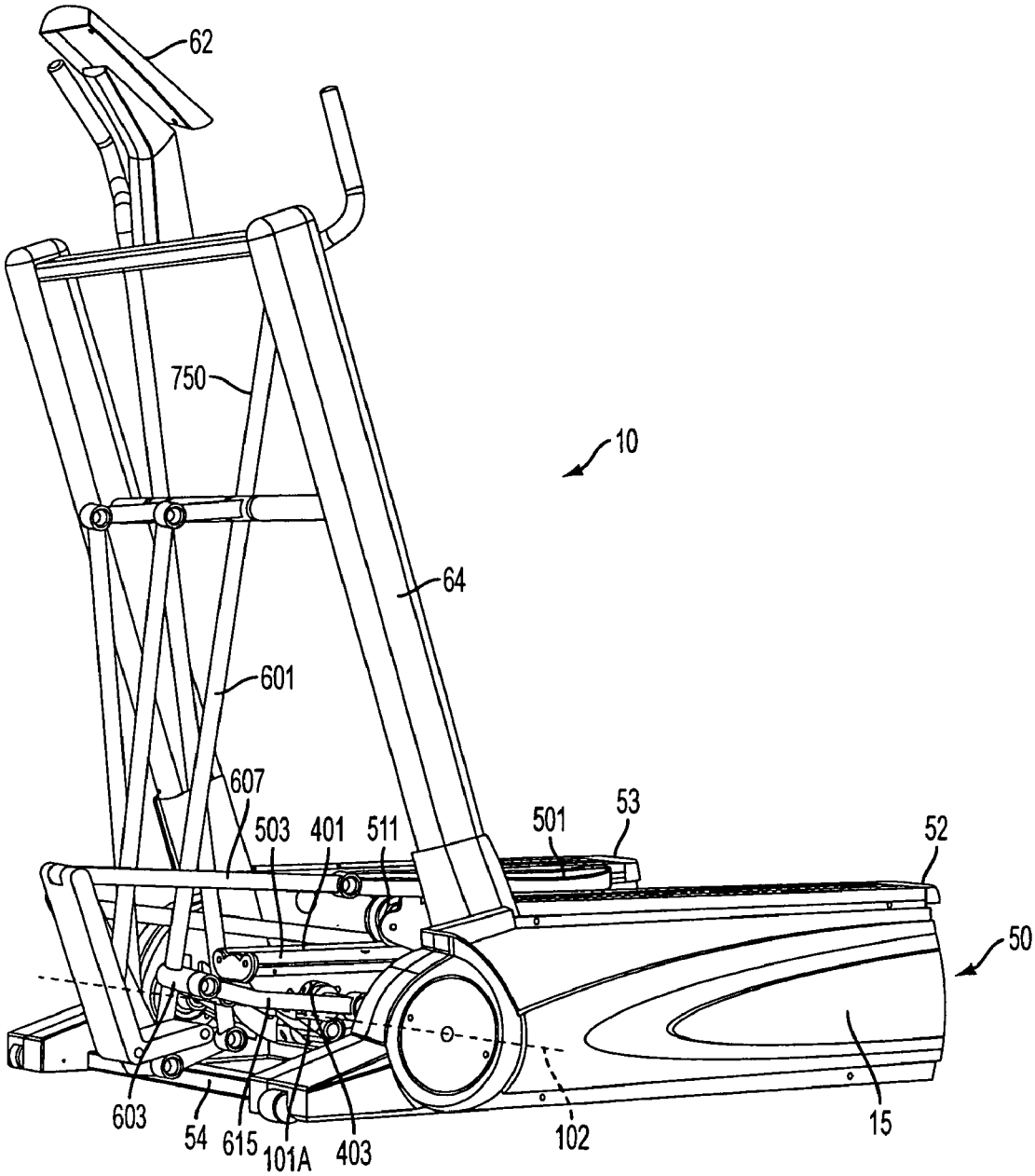
FIG. 5 shows a front perspective view of another embodiment of an exercise machine with adjustable stride length with an optional frame cover in place.
Figure 6:
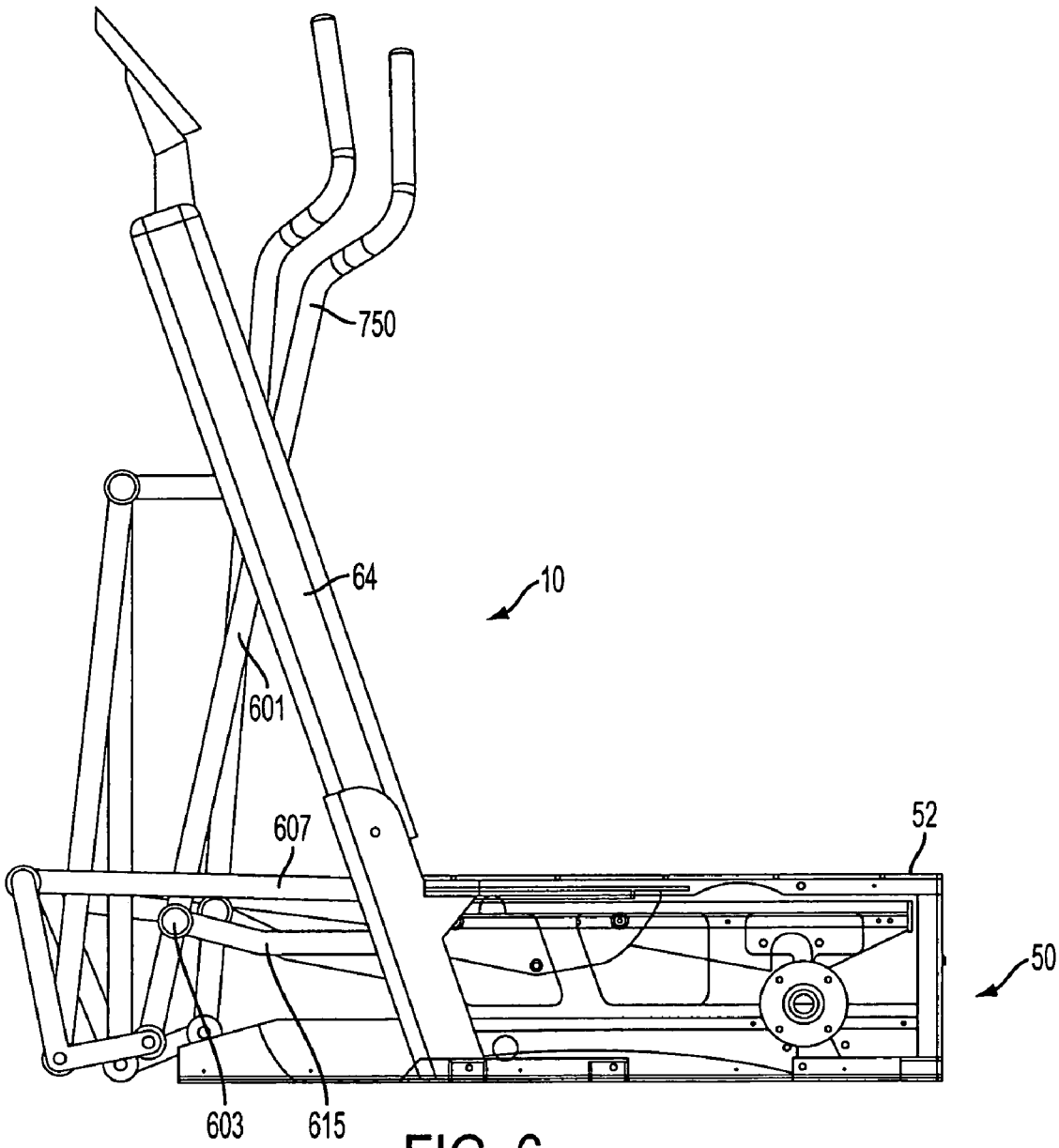
FIG. 6 shows a left side view of the embodiment of FIG. 5 with the frame cover removed.

The main supports (52) and (53) will generally rest on the surface upon which the exercise machine (10) is placed. This surface will generally be flat. One of ordinary skill in the art would understand that the surface need not be flat as the position of the machine is only important relative to the user but, for clarity, this disclosure will presume that the machine is placed on a flat surface. The main supports (52) and (53) are then held at a position spaced apart from each other by the crossbeams (54). There may be any number of crossbeams and the depicted number of three is by no means required. The exercise machine may also include some form of vertical riser (64) attached to the remainder of the frame. The vertical riser (64) may have a computer control panel (62) attached thereto for controlling the exercise and may provide for a handgrip position (66) for the user to stabilize their body while moving their feet or a mounting point for arm exercise mechanisms (750) as shown in the embodiment of FIGS. 5 and 6 and discussed later.

Any portion of the frame (50) may be covered by a cover (15) which need not provide for specific strength and support of the other components of the machine (10), but may serve to cover operating or moving parts of the machine (10) for aesthetic or safety purposes such as to keep an individual's clothing from becoming trapped in the machine (10) or simply to give the machine a particular "look."

Figure 9:
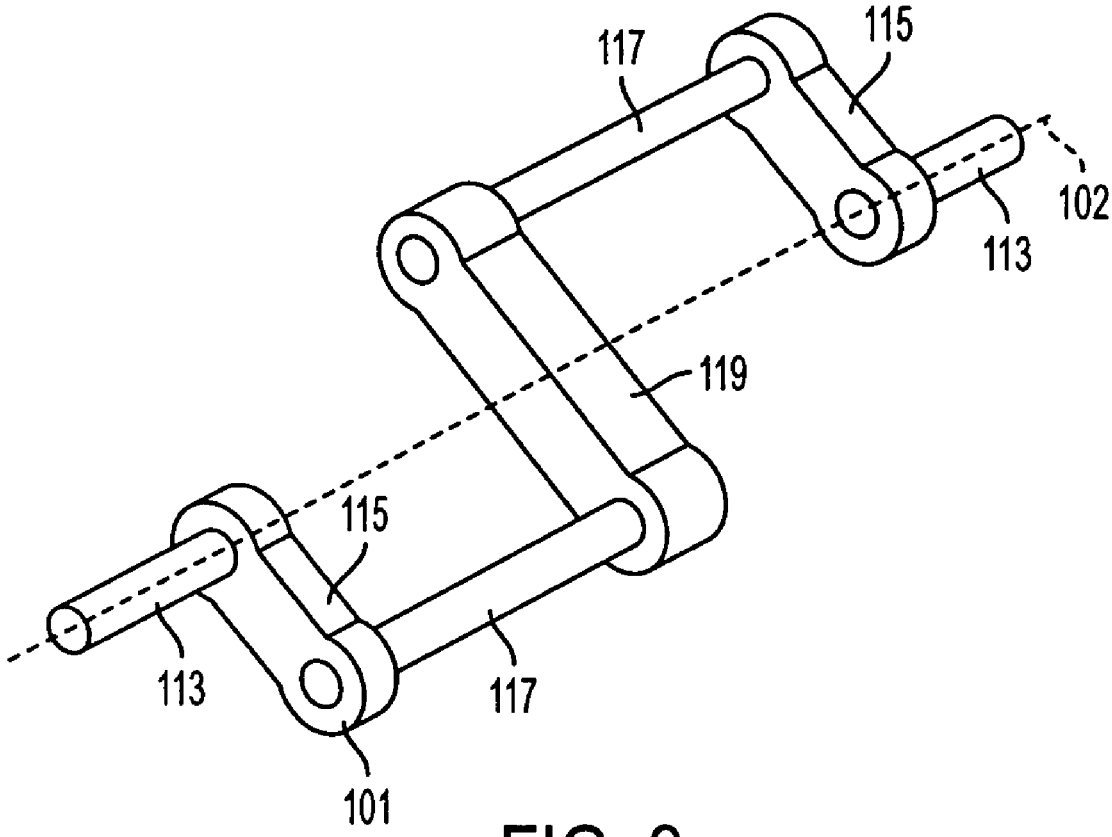
FIG. 9 shows a detail view of the crankshaft. Both front and rear use the same crankshaft.

Attached between the main support beams (52) and (53) are a pair of crankshafts (101A) and (101B). The front crankshaft (101A) is arranged generally toward the front of the machine (10) while the rear crankshaft (101B) is arranged toward the rear. Front and rear are arbitrarily assigned, but relate to the user's usual facing when using the exercise machine (10). Each crankshaft (101A) and (101B) is of similar design, generally of the design shown in FIG. 9 and rotates relative to the frame (50) about a central axis (102) as is best seen in the depiction of the crankshaft (101) shown in FIG. 9. The crankshaft (101) will be attached to the frame (50) through bearing assemblies around the axial portions (113) of the crankshaft (101). As shown in FIG. 9, the crankshaft (101) comprises the axial portions (113) of the shaft, two crank arms (115) which are 180 degrees separated, two crank pins (117), each of which is arranged generally parallel to the axis of rotation of the crankshaft (101), and a connecting web (119) between the two crank pins (117). The resultant design of crankshaft (101) therefore has the two crank pins (117) arranged generally 180 degrees out of phase with each other. The rear crankshaft (101) is of a similar design.

In operation, the two crankshafts (101) are preferably placed in the frame (50) in such a manner that they are rotating at a similar relative position. That is, the crank pin (117) on the right side of the front crankshaft (101A) is in the same arcuate position as the crank pin (117) on the right side of the rear crankshaft (101B) at any instant in time. This arrangement is what is depicted in FIGS. 1 through 3 and provides that each of the rails (401), which is arranged to be attached simultaneously to both the same side crank pins (117) of both crankshafts (101), will move in a pattern whereby the rails (401) are parallel to their position at any other time during rotation. This arrangement is not, however, required, and in an alternative embodiment, the crankshafts (101) are placed to be slightly out of phase with each other. If placed out of phase, the rails (401) will perform a levering motion about a central pivot point as the crankshafts (101) rotate.

The two same side crank pins (117) on the crankshafts (101), as discussed above, are each connected by a rail (401). The rail (401) is attached to the appropriate crank pin (117) toward the similar end of the rail (401) through a support pivot (403). The support pivot (403) provides a single axis of rotation relative to each of the crankshafts (101) and allows the rail (401) and the crank pin (117) to freely rotate about each other at that axis of rotation. As the crankshafts (101) are connected by the rails (401), it should be apparent that as each of the crankshafts (101) moves through the circle of rotation, the rails (401) force the other of the crankshafts (101) to move through the circle at a similar rate. Still further, any point on either rail (401) transcribes a circle at the same rate that each of the crank pins (117) transcribes a circle. The two crankshafts (101) are, therefore, in the depicted embodiment, arranged to operate in simultaneous rotational position. Further, due to the design of the crankshafts (101), the two rails (401) will be essentially arranged to rotate 180 degrees out of phase with each other.

By placing the user's feet directly on the rails (401), the user will be able to exercise with the machine (10) with their feet transcribing circular motion in a constantly parallel position. This circular motion may be made elliptical by providing a footskate (501) which will slide on the rail (401) at a particular rate related to the instantaneous position of the rail (401). Such sliding motion allows for alteration of the travel path of the user's foot from that of a circle to one approaching an ellipse. Traditionally, this elliptical motion was provided in a fixed fashion by interaction with swinging arms used by the user. One such arrangement of components is shown in U.S. Pat. No. 6,835,166, the entire disclosure, of which is herein incorporated by reference.

There may also be included a variety of other components as is known to those of ordinary skill in the art for improving exercise motion upon which at least one of the crankshafts (101) interacts. For example, the crankshaft (101) may be connected to a flywheel (not shown) by means of a belt (not shown) so as to provide for more fluid and smooth motion of the rails (401) as the crankshafts (101) are rotated. The inclusion of such a flywheel is well known to those of ordinary skill in the art and allows for the storage of inertial energy so that once the rails (401) have begun to rotate, the rotation is maintained in a smooth fashion.

Further, there may be a resistance device (not shown) included to provide for resistance to the motion of either crankshaft (101) and therefore to increase the difficulty of the exercise. The resistance device may comprise a friction belt which serves to resist the rotation of the wheel (121). As the belt is tightened on the wheel (121), the amount of force required to move the crankshaft (101), and to maintain its steady rotation, is increased providing for a more difficult exercise. This design of resistance device is by no means required, however, and any type of resistance device, including but not limited to, friction devices, electromechanical devices, pneumatic or hydraulic devices, or a combination of devices may be used to provide resistance.

While not shown, the exercise machine (10) may also include an electric drive or electric assist mechanism. While the exercise motion preferably uses motion of the legs to drive the crankshafts (101) and (103) through their desired motion as the provision of exercise, it is recognized that in some cases, a user may lack the requisite strength to commence the exercise or to comfortably perform it. Such an assistance mechanism for use in conjunction with arm driven treadmills, which could be adapted for use with this elliptical machine (10), is shown in U.S. Patent Application No. 60/613,661, the entire disclosure of which is herein incorporated by reference.

Figure 7:
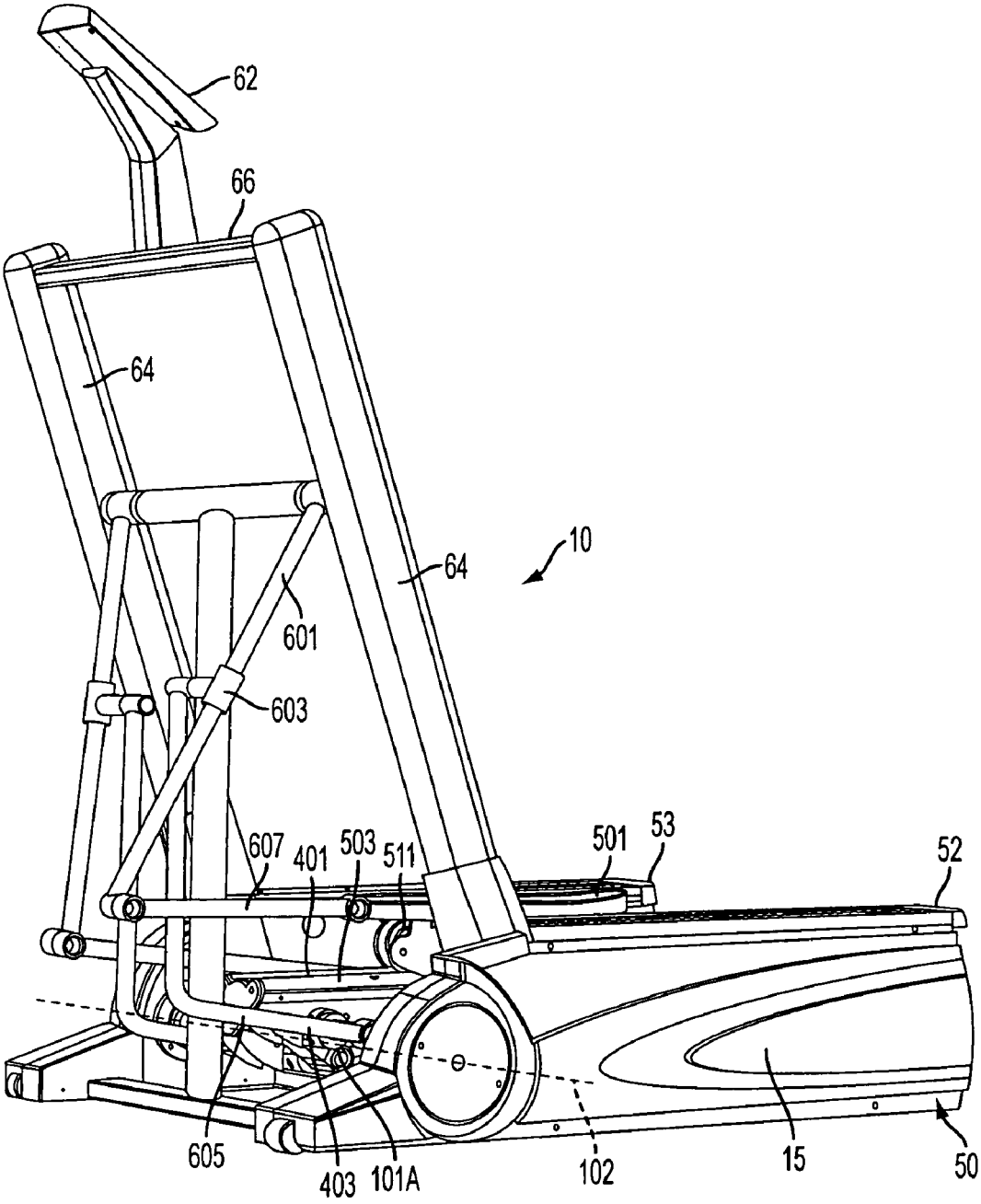
FIG. 7 shows a front perspective view of another embodiment of an exercise machine with adjustable stride length with an optional frame cover in place.
Figure 8:
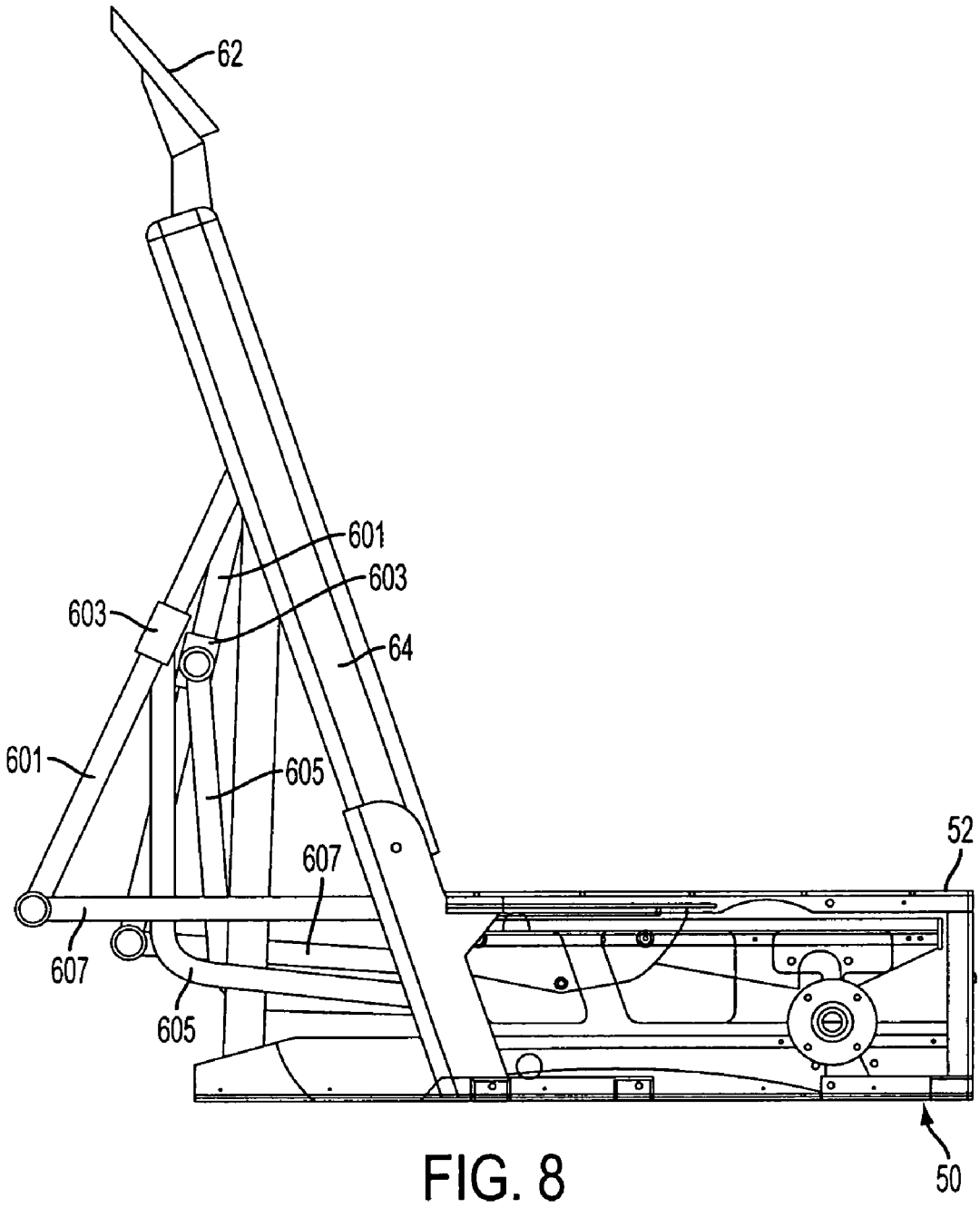
FIG. 8 shows a left side view of the embodiment of FIG. 7 with the frame cover removed.

As discussed above, so as to provide for elliptical instead of circular motion of the user's foot, each of the rails (401) has located thereon a footskate (501) which is arranged to reciprocate on a foot track (503) which is located on the rail (401). The reciprocating relationship may be accomplished by any mechanism known to those of ordinary skill in the art including sliding or rolling relationships. In the depicted embodiment, the footskate (501) includes a series of wheels (511) which roll on the foot track (503) as depicted. In the depicted embodiment, the adjustable motion is accomplished by the inclusion of an inverted pendulum arm (601) having a coupler (603) thereon, the coupler (603) being attached via an interface arm (605) to the rail (401). The inverted pendulum arm (601) also has a transfer arm (607) connected thereto to transfer a portion of the oscillating pendulum motion from the inverted pendulum arm (601) to the footskate (501). The inverted pendulum arm (601) need not necessarily utilize inverted pendulum motion in an alternative embodiment. Instead, it may utilize a sideways pendulum motion. The embodiment of FIGS. 7 and 8 shows a still further alternative embodiment with an upright pendulum that uses upright pendulum motion. An inverted pendulum motion is generally preferred, however, for inverted pendulum arm (601) as it usually allows for a more mechanically simple structure The motion imparted to the footskate (501) in this embodiment is relatively straight forward and is illustrated by the simplified conceptual drawing of FIG. 4. As the rail (401) rotates through the circle imparted by the rotational motion of the crankshafts (101), the interface arm (605) provides that a component of the rail's (401) movement is imparted to the coupler (603) forcing the coupler (603) to rotate through a particular arcuate distance. The coupler (603) is preferably located in a sliding lockable relationship with the inverted pendulum arm (601). The sliding relationship is not a free slide during the exercise, but instead the coupler (603) is placed in a preselected position and locked or otherwise held to produce a particular radius of rotation between the coupler (603) and the axis (609) of the inverted pendulum arm (601). The coupler (603) may later be unlocked and moved to a second preselected point and again locked. Different motions are obtained depending on the location of the coupler (603) (illustrated by the range A) on the inverted pendulum arm (601). By placing the coupler (603) at any predetermined location in range A, the length of the stride for each rotation of crankshafts (101) become fixed while the coupler (603) remains at that position. At the same time, since the predetermined location can be changed, the stride length can be altered by moving the coupler (603). While this disclosure references "locking" and "unlocking" the coupler (603), it would be apparent to one of ordinary skill in the art that the coupler (603) need not specifically "lock" but may be held in place by friction or other resistance.

The operation of moving the coupler (603) provides for adjustment by changing the angle through which the inverted pendulum arm (601) rotates with each rotation of the rail (401). In particular, as should be apparent from FIG. 4, the interface arm (605) is of fixed length and is attached to the front end (431) of the rail (401). As the rail (401) circularly rotates due to the motion of the crankshafts (101), the interface arm's (605) proximal end (615) which is rotationally connected to the front end (431) of the rail (401) also rotates through a similar circular path. A portion of this movement is translated by the interface arm (605) to the coupler (603). Since the coupler (603) is in a predetermined fixed position relative to the inverted pendulum arm (601), the motion of the interface arm (605) is translated to the rocking (reciprocating or oscillating) movement of the inverted pendulum arm (601).

As should be apparent, the angle that the inverted pendulum arm (601) moves through, in conjunction with a singular rotation of the crankshafts (101), is based on the movement applied to it by the interface arm (605) and the radius of the inverted pendulum arm (601) between the axis of rotation (609) and the coupler (603). In particular, if the coupler (603) is placed toward the distal end (621) of the inverted pendulum arm (601), the radius is greater from the axis of rotation (609) to the coupler (603) (as the axis of rotation (609) does not move) than if the coupler (603) is placed toward the proximal end (611). The motion of the interface arm (605) is defined by the motion of the rail (401) and effectively defines the arc length through which the coupler (603) travels. As the rail's (401) movement is relatively constant, this arc length is therefore relatively constant.

As is known to those of ordinary skill in the art, with a fixed arc length, an increase in the radius results in the angle through which the inverted pendulum arm (601) moves being smaller. Effectively, as the radius increases, the circumference of the circle increases, therefore as the arc length is constant, the percentage of the circle traversed by the coupler (603) decreases. On the other hand, if the coupler (603) is moved closer to the proximal end (611) of the inverted pendulum arm (601), the radius is shortened and the constant arc length is a greater percentage of the circumference of the circle. Therefore, the angle through which the inverted pendulum arm (601) swings is increased.

To provide for this change in angle to alter the stride length of the exercise, there is included a transfer arm (607), which serves to adjust the motion of the footskate (501)

based on the angular distance traversed by the inverted pendulum arm (601). The transfer arm (607) is attached a fixed distance along the length of the inverted pendulum arm (601), generally at or toward its distal end (621). The transfer arm (607) is rotationally connected between the inverted pendulum arm (601) and the footskate (501) in a manner such that a component of the inverted pendulum arm's (601) motion is translated to the footskate (501), the component being directly related to the angle through which the inverted pendulum arm (601) moves. Because the transfer arm (607) is at a fixed distance on the inverted pendulum arm (601), a change in the angular dimension corresponds to a difference in the horizontal movement of the footskate (501). The greater the angular distance, the greater the motion imparted to the footskate (501).

The transfer arm (607) will generally be attached to the inverted pendulum arm (601) so that the effective radius of rotation of its proximal end (617) about the axis of rotation (609) is greater than the radius of rotation of the coupler (603) about the axis of rotation (609). If the effective radius of the transfer arm (607) is greater, the oscillation of the footskate (501) will constructively impart a horizontal motion to the horizontal movement of the rail (401). That is, the long axis of the ellipse will be horizontal and will be greater than the radius of the circle made by the rail (401) on the crankshafts (101). If the radius of the transfer arm (607) is less than the radius of the coupler (603), the footskate (501) will oscillate destructively, which will make the vertical axis of the ellipse the longest by shrinking the horizontal motion mount to be less than the radius of the circle made by the rails (401). If the radii of the transfer arm (607) and coupler (603) are equal, then the footskate (501) will basically move as if it was permanently mounted to the rail (401) and will not oscillate significantly on the rail (401).

It is preferred that the radius from the transfer arm (607) to the axis of rotation (609) be larger than the radius from the coupler (603) to the axis of rotation (609) as elliptical motion with the larger dimension in the horizontal direction is generally the preferred exercise motion. For this reason, the transfer arm (607) in the depicted embodiment is located toward the distal end (611) of the inverted pendulum arm (601) while the coupler (603) can be moved over the length of the inverted pendulum arm (601).

Due to the interconnection of the rail (401) with the inverted pendulum arm (601) and in turn the relationship of the motion of the inverted pendulum arm (601) to the motion of the footskate (501), it should be apparent that there is no need for complicated timing methodologies to make the footskate (501) oscillate in conjunction with the rail (401) in either a prepared constructive or destructive manner. In particular, the footskate's (501) movement depends on the relative position of the transfer arm (607) to the coupler (603). This is as opposed to prior designs which relied on timing relationships and placement of drive links in the rotation of the crankshafts (101) and (103) to determine the effect.

As the inverted pendulum arm (601) rotates through the angle determined by the coupler's (603) position, the transfer arm's (607) proximal end (617) is also moved through the same angle. The transfer arm (607) will then transfer a component of that arc length to the footskate (501) causing the footskate (501) to also reciprocate. As should be apparent, because the transfer arm (607) is always located at a greater radius than the coupler (603) in the depicted embodiment, a greater horizontal component of motion is provided to the proximal end (617) of the transfer arm (607) compared to the horizontal component on the coupler (603). Further, the distance moved by the transfer arm (607) corresponds to the angle through which the inverted pendulum arm (601) is moved.

Figure 4:
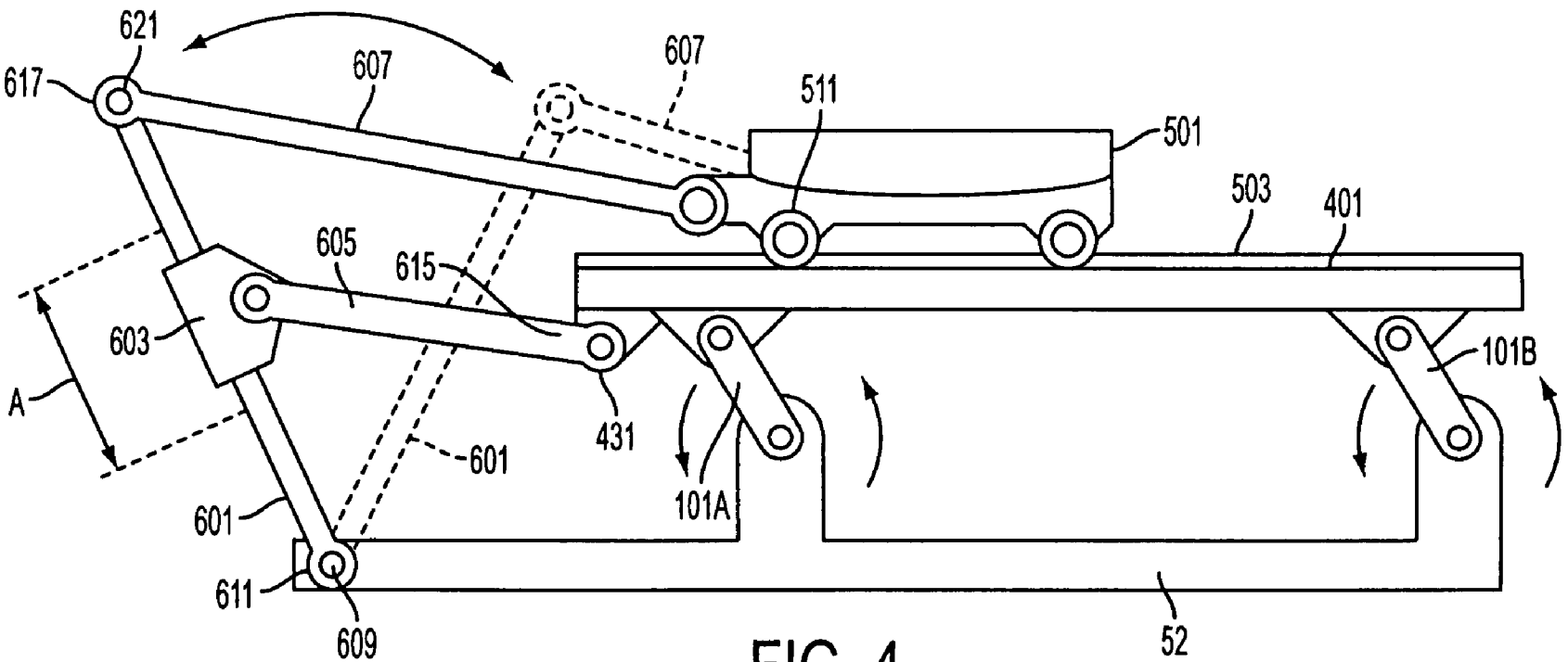
FIG. 4 shows a simplified structure of a single footskate and rail to show motion.

As should be apparent from the drawings of FIGS. 1 through 3, the exercise machine (10) depicted therein provides for adjustable footskate (501) motion in the same manner as the conceptual drawing in FIG. 4. The embodiment of FIGS. 7 and 8 also operates in the same manner except the inverted pendulum arm (601) is inverted to provide a slightly different layout of components. However, the concept is the same. It should be recognized that in the embodiments of FIGS. 1 to 3 and 7 and 8 the foot motion is provided completely independent of any arm motion. Arm exercise mechanisms are generally oscillating devices that move with a user's arms while their feet move with the footskates, generally to additionally exercise the user's upper body. In prior designs, footskate (501) reciprocation was tied to the reciprocation of arm exercise mechanisms on the exercise machine (10) that the user manipulated to exercise their upper body. While arm exercise mechanisms are often included on exercise machines (10), certain individuals do not like to use them. Therefore, their inclusion on a machine (10) where they are not going to be used is undesirable and potentially problematic. In particular, in this situation the arm exercise mechanisms move but are not directly under the control of the user, as the user does not use them to exercise, and they require space in which to move.

The exercise machine (10) of these embodiments, by not requiring arm exercise mechanisms, provides for an increase in flexibility. Most noticeably, the exercise machine (10) can be significantly more compact and may be able to be more easily portable or to fold up for improved storage characteristics. Also, if arm exercise mechanisms are desired, their motion need not be tied to the footskate (501) reciprocation, but may instead be tied to other reciprocation such as the reciprocation of the rails (401). An embodiment utilizing this design is shown in FIGS. 5 and 6. In other designs, as footskate reciprocation was altered, the user's arm oscillation motion was also altered, which forced the arm oscillation to change in conjunction with the foot oscillation. This can be uncomfortable to the user who may not alter their arm motion as much as their foot motion when changing their stride length. In particular, a user may actually use the same arm motion when running or walking.

In the embodiment depicted in FIGS. 5 and 6, the arm motion of the user is adjustable as the arm exercise mechanism (750), which comprises oscillating rods in this case, is linked to the rotation of the rail (401) (or a crankshaft (101) as the motions are directly related). This provides for the ability to alter the motion of the arm exercise mechanism (750) differently than the motion of the footskate. While the coupler (603) adjustment still alters the motion of the arm exercise motion in this case, the footskate (501) motion is relatively unaltered. In a still further embodiment, the opposite could be performed with the footskate (501) adjusting while the arm exercise mechanism (250) does not. Still further, in the above embodiment, the arm exercise mechanism (750) need not be linked at all or could be linked to the footskate motion depending on what is desired by the user. Therefore, this exercise machine (10) provides increased flexibility and options. The embodiment of FIGS. 5 and 6 provides for a similar concept of motion in FIG. 4, however the inverted pendulum arm (601) is inserted for ease of concept.

As touched on before, the machine (10) can have a much more compact arrangement as is shown in FIGS. 1 through 3. The adjustable stride mechanism does not take up much significant additional space compared to a similar system having a fixed stride and can be quite a bit more compact than alternative elliptical systems. This provides for an adjustable system with a more compact footprint and decreased space requirement than for other adjustable stride systems.

To adjust the dimensions of the exercise in the embodiments, the exercise machine (10) provides for adjustment of the coupler (603) on the inverted pendulum arm (601) as can be seen in the views of FIG. 4. The coupler (603) can be adjusted by the placement of an adjustment mechanism (not shown) which is designed to allow the coupler (603) to move up and down on the inverted pendulum arm (601). The adjustment mechanism may be any type of device, but in the preferred embodiment may simply be a frictional connector, or other device which can be adjusted indirectly. In an alternative embodiment, the coupler (603) may include a toothed gear, wheel, or other device which is designed to roll along the surface of the inverted pendulum arm (601) and then hold in position on the inverted pendulum arm (601), or may be a hydraulic, pneumatic or other cylinder which moves in parallel with the inverted pendulum arm (601).

In a still further embodiment, the coupler (603) may include a locking pin and series of predetermined holes. In this embodiment, the user may position the coupler (603) lined up with a predetermined hole set on the inverted pendulum arm (601) and then place a pin through the holes to mount the coupler (603) to the inverted pendulum arm (601). This type of design is less preferred as it generally does not allow for on-the-fly adjustment of the footskate (501) reciprocation, but is useful in some embodiments.

As should be apparent from the above, while the depicted embodiments perform the adjustment to footskate (501) reciprocation by moving the coupler (603), this is not strictly required. In an alternative embodiment, footskate (501) reciprocation adjustment can be accomplished by moving different components. The adjustment to stride length occurs not because any particular parts changed position on the inverted pendulum arm (601), but because the radius from the axis of rotation (609) to the coupler (603) changed relative to the radius of the axis of rotation (609) to the proximal end (617) of the transfer arm (607). Therefore, while the above discusses altering the coupler's (603) radius while keeping the transfer arm's (607) radius constant, different types of literal motion may be used to perform a similar relative change.

In particular, the coupler (603) may be arranged in a fixed position, while the inverted pendulum arm (601) comprises a piston or similar structure which allows for the connection point at it's distal end (621) to the proximal end (617) of the transfer arm (607) to be adjusted relative to the coupler (603). The same net effect of altering the stride length is obtained in this embodiment as in the embodiment depicted. From the above, it should also be further apparent, that both the coupler (603) and proximal end (617) of the transfer arm (607) may be adjusted together in a still further embodiment. Additionally, other adjustments can be made depending on the specific relative motion to be used.

The adjustment mechanism can preferably be used by the machine (10) in conjunction with the exercise being performed or to provide for "on-the-fly" adjustment of the stride. This intraexercise adjustment allows for increased functionality of the machine (10), comfort for the user, and control over the available exercise options. By providing "on-the-fly" adjustment, the user can change the stride during an exercise to allow the exercise machine (10) to have a more natural or more comfortable motion of the user depending on the amount of resistance and the type of motion they are performing.

In an embodiment, the machine (10) will utilize the adjustable stride via a computer control panel (62), as mentioned earlier, which will be used to select exercise characteristics. Generally, the user will preselect a program of exercise which corresponds to various different types of motion to be performed according to a pattern, over time, and the computer control panel (62) will adjust the stride length and resistance device (if present) to provide for different types of comfortable motion at different times in the exercise program.

In an exemplary exercise program, the user may start off with a warm up period of light walking, then go into an alternating period of fast running and slower climbing, and then end with a period of slower cool down. The device can create this exercise by beginning with a period of intermediate stride length at a relatively low speed of rotation and low resistance. This would conform to a quick walk. The user can then be instructed to speed up the stride and as the user's stride begins to accelerate, the machine can adjust the stride length to be longer while lowering the resistance. This would conform more to a running motion. The user can then be instructed to slow up their stride as the machine starts to decrease the stride length and in fact may reduce the stride length to a more circular motion while increasing the resistance. This provides for a more of a climbing motion. As the user enters the cool down section, the stride length can again be adjusted more toward the middle stride length or walking motion again.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An elliptical exercise machine comprising:

a frame;

at least two crankshafts rotationally connected to said frame;

a rail attached to said crankshafts so that said rail traverses a path in conjunction with the rotation of said crankshafts;

a footskate capable of reciprocating motion on said rail;

an interface arm, said interface arm having a distal and proximal end and a length therebetween, said proximal end of said interface arm being connected to said rail;

an inverted pendulum arm having a proximal and distal end and a length therebetween, said inverted pendulum arm rotating about an axis of rotation located toward said proximal end of said inverted pendulum arm;

a coupler connecting said distal end of said interface arm to said inverted pendulum arm at a point along said length of said inverted pendulum arm, said distance between said coupler and said first axis defining a first radius; and a transfer arm having a proximal and distal end and a length therebetween, the transfer arm being attached at said proximal end to said inverted pendulum arm, said transfer arm also being connected at said distal end to said footskate, said distance between said proximal end of said transfer arm and said first axis defining a second radius;

wherein said interface arm causes said inverted pendulum arm to reciprocate about said first axis, which in turn causes said transfer arm to make said footskate reciprocate on said rail; and wherein said first radius and said second radius are adjustable relative to each other.

2. The machine of claim 1 wherein said second radius is adjustable.

3. The machine of claim 2 wherein said first radius is fixed.

4. The machine of claim 1 wherein said first radius is adjustable.

5. The machine of claim 4 wherein said second radius is fixed.

6. The machine of claim 1 further comprising an adjustment mechanism for adjusting at least one of said first radius and said second radius.

7. The machine of claim 6 wherein said adjustment mechanism includes a hydraulic cylinder.

8. The machine of claim 6 wherein said adjustment mechanism is electrically powered.

9. The machine of claim 6 wherein said adjustment mechanism include a worm screw.

10. The machine of claim 6 wherein said adjustment mechanism is hand powered.

11. The machine of claim 1 wherein at least one of said crankshafts is attached to a flywheel.

12. The machine of claim 11 wherein at least one of said crankshafts is attached to a resistance device.

13. The machine of claim 1 wherein the position of said rail at any selected point of rotation, is parallel to the position of said rail at any other selected point of rotation.

14. The machine of claim 1 further comprising an arm exercise mechanism which oscillates relative to said frame.

15. The machine of claim 14 wherein the angle through which said arm exercise mechanism oscillates is independent of the reciprocation of said footskate.

16. A method of altering the stride length of an elliptical exercise machine during an exercise, the method comprising:

providing an elliptical exercise machine; the machine including:

a frame;

at least two crankshafts rotationally connected to said frame;

a rail attached to said crankshafts so that said rail traverses a path in conjunction with the rotation of said crankshafts;

a footskate capable of reciprocation motion on said rail;

an interface arm said interface arm having distal and proximal ends and a length therebetween, said proximal end of said interface arm being connected to said rail;

an inverted pendulum arm having a proximal and distal end and a length therebetween, said inverted pendulum arm rotating about an axis of rotation located toward said proximal end of said inverted pendulum arm;

a coupler connecting a distal end of said interface arm to said inverted pendulum arm along said length of said inverted pendulum arm, said distance between said coupler and said first axis defining a first radius; and a transfer arm having a proximal and distal end and a length therebetween, the transfer arm being attached at said proximal end to said inverted pendulum arm, said transfer arm also being connected at said distal end to said footskate, said distance between said proximal end of said transfer arm and said first axis defining a second radius;

operating said machine so that said interface arm causes said inverted pendulum arm to reciprocate about said first axis, which in turn causes said transfer arm to reciprocate said footskate on said rail; and adjusting said first radius or said second radius relative to the other while said machine is operating.

17. The method of claim 16 wherein during said step of adjusting, said second radius is adjusted.

18. The method of claim 17 wherein during said step of adjusting, said first radius remains constant.

19. The method of claim 16 wherein during said step of adjusting, said first radius is adjusted.

20. The method of claim 19 wherein during said step of adjusting, said second radius remains constant.

* * * * *